US007568744B2

(12) United States Patent
Tenorio et al.

(10) Patent No.: US 7,568,744 B2
(45) Date of Patent: Aug. 4, 2009

(54) VEHICLE DOOR HANDLE ASSEMBLY

(75) Inventors: Aaron Tenorio, Shelby Township, MI (US); Adam Tacey, Waterford, MI (US)

(73) Assignee: Nissan Technical Center North America, Inc., Farmington Hills, MI (US)

( * ) Notice: Subject to any disclaimer, the term of this patent is extended or adjusted under 35 U.S.C. 154(b) by 222 days.

(21) Appl. No.: 11/231,986

(22) Filed: Sep. 22, 2005

(65) Prior Publication Data

US 2007/0069532 A1 Mar. 29, 2007

(51) Int. Cl.
*E05B 3/00* (2006.01)
*E05B 65/10* (2006.01)

(52) U.S. Cl. ..... 292/336.3; 292/92; 292/DIG. 65

(58) Field of Classification Search ..... 292/92, 292/336.3, DIG. 65
See application file for complete search history.

(56) References Cited

U.S. PATENT DOCUMENTS 3,719,248 A * 3/1973 Breitschwerdt et al. ..... 180/271
4,883,296 A * 11/1989 Laurie ..... 292/336.3
5,725,262 A * 3/1998 Kritzler ..... 292/336.3
6,010,167 A 1/2000 Tanimoto et al.
6,401,302 B1 * 6/2002 Josserand et al. ..... 16/444
6,447,030 B1 * 9/2002 Meinke ..... 292/347
6,543,090 B2 * 4/2003 Muneta ..... 16/412
6,554,331 B2 4/2003 Ciborowski et al.
6,565,134 B1 5/2003 Stuart et al.
6,575,508 B2 6/2003 Stuart et al.
6,588,813 B1 * 7/2003 Marcarini et al. ..... 292/347
6,749,236 B2 * 6/2004 Nomura et al. ..... 292/336.3
7,303,217 B2 * 12/2007 Savant ..... 292/336.3
2004/0217602 A1 * 11/2004 Nomura et al. ..... 292/336.3
2005/0134059 A1 * 6/2005 Ichino ..... 292/336.3
2005/0161959 A1 * 7/2005 Belchine, III ..... 292/336.3

* cited by examiner

*Primary Examiner*—Peter M Cuomo
*Assistant Examiner*—Alyson M Merlino
(74) *Attorney, Agent, or Firm*—Global IP Counselors, LLP

(57) ABSTRACT

A vehicle door handle assembly includes a mounting bracket and a handle. The mounting bracket is configured and dimensioned to be mounted within a vehicle door. The handle is pivotally coupled to the mounting bracket to pivot about a pivot axis between a latching position and a latch release position. The handle is basically an elongated member that includes a pivot portion, a grip portion and a counterbalancing portion. The grip portion extends perpendicularly relative to the pivot axis from a first side of the pivot portion. The counterbalancing portion extends perpendicularly relative to the pivot axis from a second side of the pivot portion. The grip portion and the counterbalancing portion are configured and dimensioned such that a center of gravity of the handle is located proximate the pivot axis.

14 Claims, 10 Drawing Sheets

VEHICLE DOOR HANDLE ASSEMBLY

BACKGROUND OF THE INVENTION

1. Field of the Invention

The present invention generally relates to vehicle door handle assembly. More specifically, the present invention relates to a vehicle door handle assembly that includes a counterweight that is located to counteract pivoting of the vehicle outside door handle when a lateral force is applied to the vehicle outside door handle.

2. Background Information

Vehicles are routinely being redesigned in order to improve reliability and safety. Door handles have been redesign recently to improve safety related to vehicular impact. Many such door handle designs include a separate counterbalance that acts on movement of the door handle to prevent the door handle from opening the door as a result of many types of vehicle impact. Such counterweights include a significant amount of mass and require a strong return spring to bias the door handle to a latched position.

One problem with such counterweights and strong return springs is that the door handle can be difficult to operate, requiring an undesirable amount of force to overcome the force of the spring to open the door. Further, during a side impact, the inertia of the mass of the counterweight under rare circumstances may be insufficient to prevent the door from opening.

In view of the above, it will be apparent to those skilled in the art from this disclosure that there exists a need for an improved door handle assembly that makes operation easier and prevent the door from opening during side impacts. This invention addresses this need in the art as well as other needs, which will become apparent to those skilled in the art from this disclosure.

SUMMARY OF THE INVENTION

One object of the present invention is to provide a door handle assembly with a counterweight that does not require a return spring having a large biasing force.

Another object of the present invention is to provide a handle of a door handle assembly with a counterweight and mounting bracket that improve safety.

In accordance with one embodiment of the present invention, a vehicle door handle assembly includes a mounting bracket and a handle. The mounting bracket is configured and dimensioned to be mounted within a vehicle door. The handle is pivotally coupled to the mounting bracket to pivot about a pivot axis between a latching position and a latch release position. The handle is an elongated member that includes a pivot portion, a grip portion and a counterbalancing portion. The grip portion extends perpendicularly relative to the pivot axis from a first side of the pivot portion. The counterbalancing portion extends perpendicularly relative to the pivot axis from a second side of the pivot portion. The grip portion and the counterbalancing portion are configured and dimensioned such that a center of gravity of the handle is located proximate the pivot axis.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
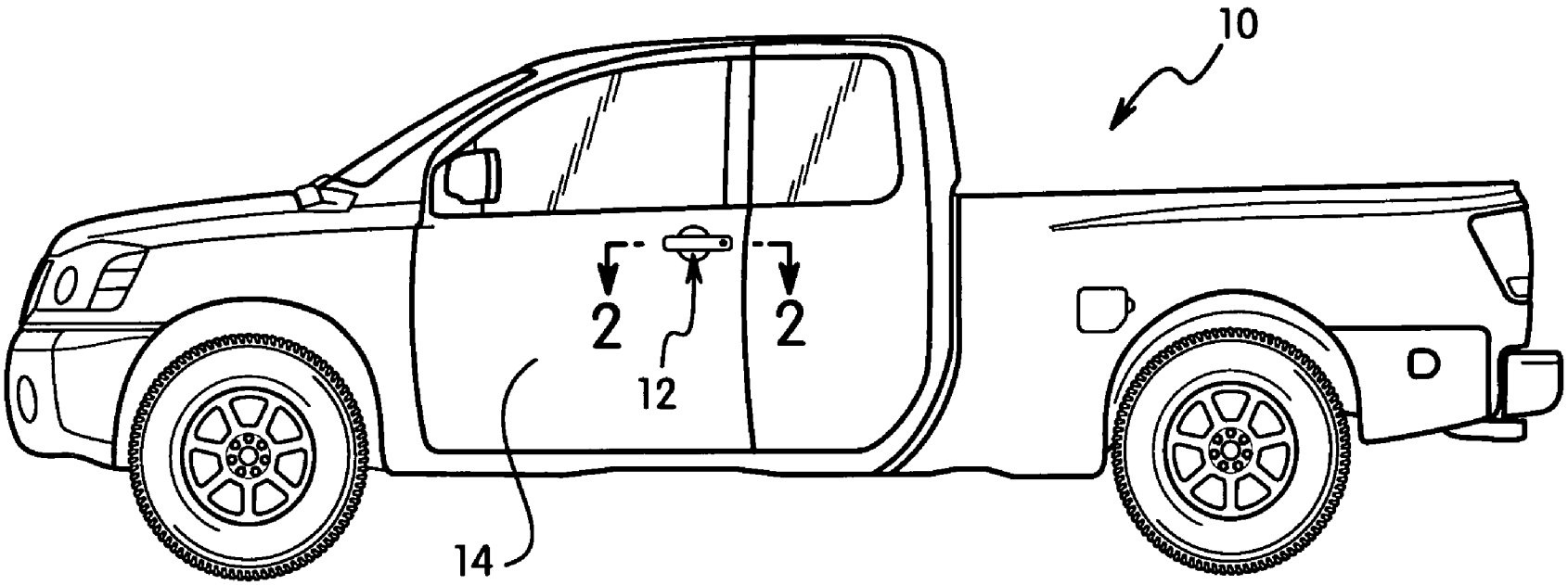
FIG. 1 is a side elevational view of a vehicle that includes a door handle assembly in accordance with the present invention.
Figure 2:
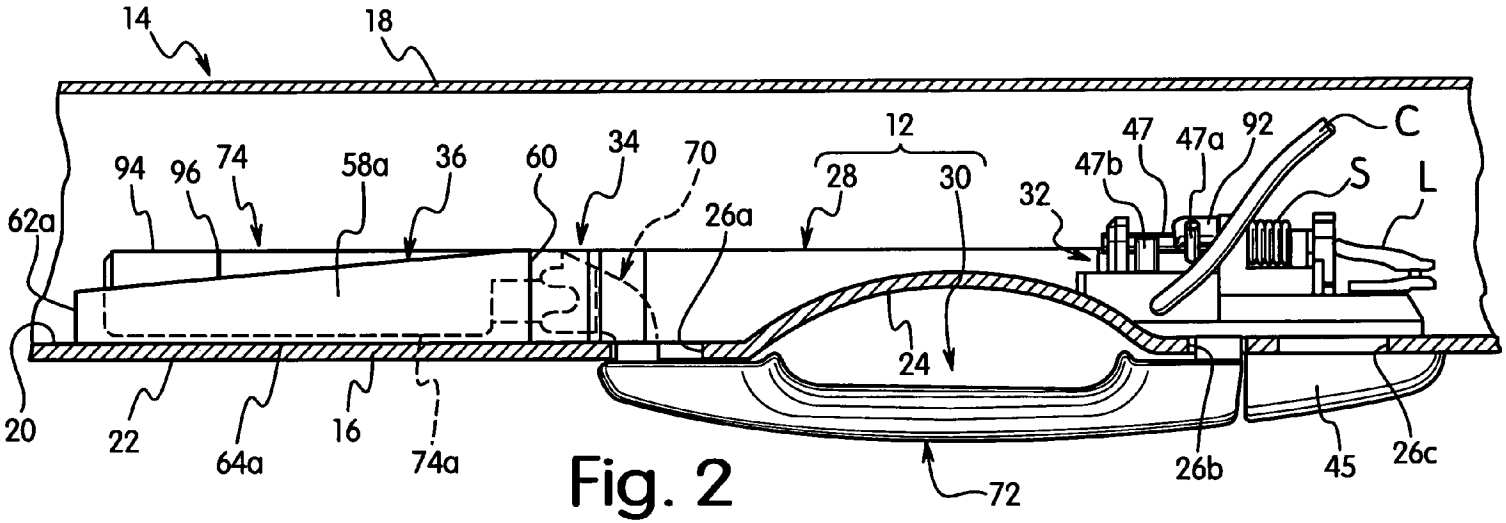
FIG. 2 is a horizontal cross-sectional view of a portion of the door taken along section line 2-2 in FIG. 1 showing with the door handle assembly in a latched position in accordance with the present invention.

Referring initially to FIGS. 1 and 2, a vehicle 10 is illustrated in FIG. 1 that includes a vehicle door handle assembly 12 installed in a door 14 in accordance with a first embodiment of the present invention. As shown in FIG. 2, the door 14 of the vehicle 10 includes an outside door panel 16 and an inside door panel 18. The outside door panel 16 is formed with an inner surface 20, an outer surface 22, a handle recess 24 and three handle receiving apertures 26*a*, 26*b* and 26*c*. The vehicle door handle assembly 12 is securely mounted to the door 14 in a conventional manner. As described in greater detail below, a portion of the vehicle door handle assembly 12 is mounted within the door 14 between the outside door panel 16 and the inside door panel 18 and a portion of the vehicle door handle assembly 12 extends outside the door 14 adjacent to the outside door panel 16. The vehicle 10 and the door 14 are conventional components that are well known in the art. Since vehicle 10 and the door 14 are well known in the art, these structures will not be discussed or illustrated in detail herein. Rather, it will be apparent to those skilled in the art from this disclosure that the components can be any type of structure and/or programming that can be used to carry out the present invention.

The vehicle door handle assembly 12 basically includes a mounting bracket 28 and a handle 30. The mounting bracket 28 is mounted to an inside surface of the outside door panel 16, with the handle 30 being pivotally mounted on the mounting bracket 28 with a potion of the handle 30 being located inside the door and a portion of the handle being located outside the door 14. The vehicle door handle assembly 12 is configured and arranged to prevent the door 14 from being inadvertently opened due to a side vehicular impact, as described in greater detail below.

Figure 8:
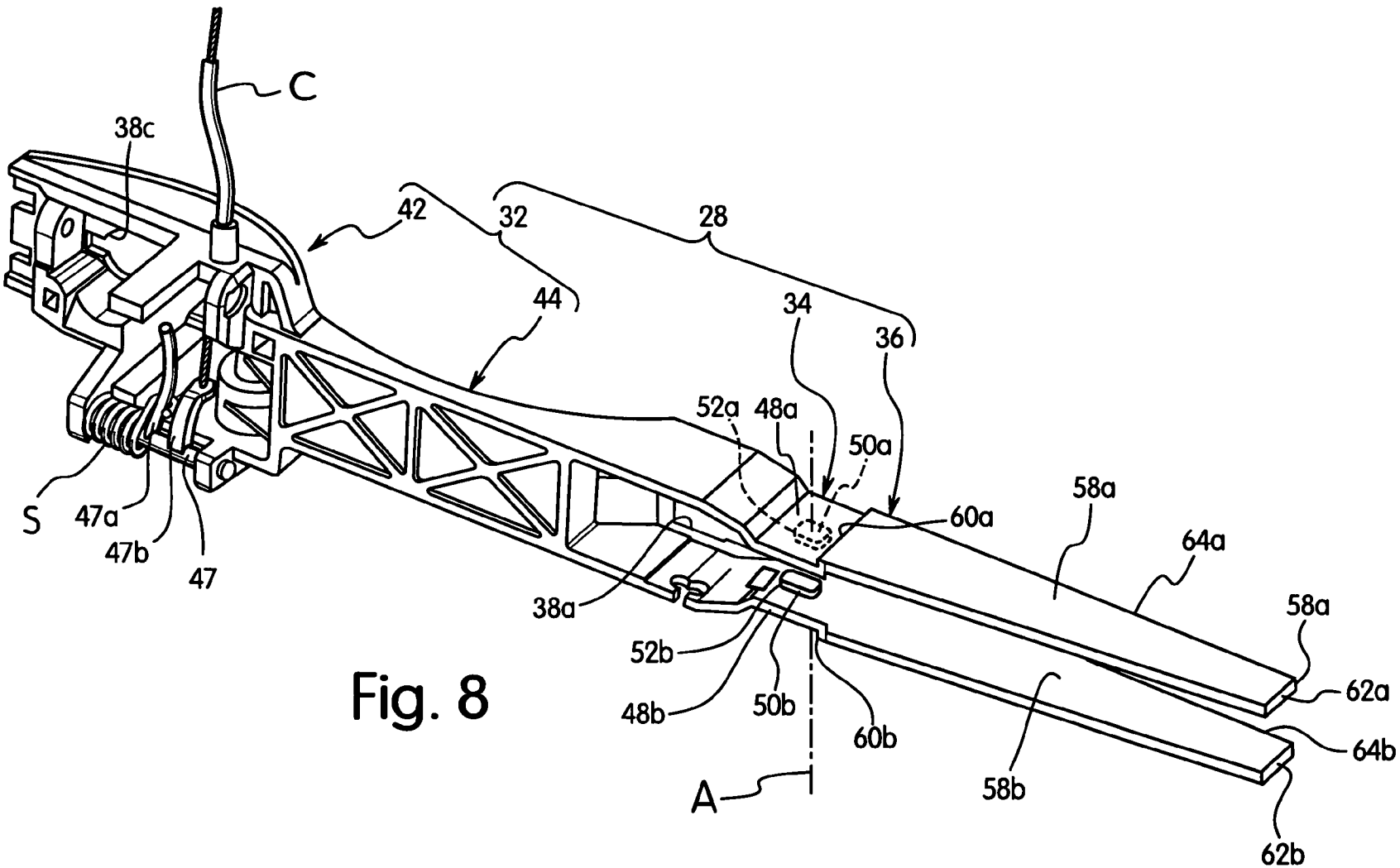
FIG. 8 is an inside perspective view of the mounting bracket of the door handle assembly with the handle removed therefrom.
Figure 9:
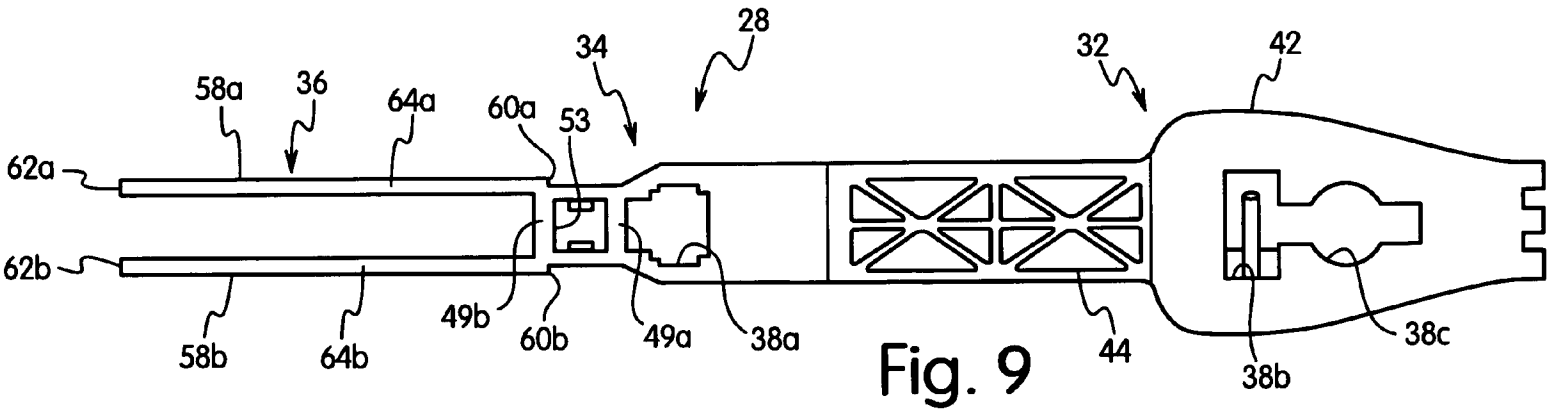
FIG. 9 is an inside elevational view of the mounting bracket of the door handle assembly with the handle removed therefrom.

As shown in FIG. 2, the mounting bracket 28 is configured and dimensioned to be mounted within the interior of the door 14. The mounting bracket 28 is fixed to the door 14 in a conventional manner, such as mechanical fasteners (not shown). The mounting bracket 28 is preferably made of a lightweight molded polymer or plastic material. As best seen in FIGS. 8 and 9, the mounting bracket 28 basically includes a mounting portion 32, a support portion 34 and an extension portion 36. The mounting bracket 28 is formed with a plurality of apertures 38*a*, 38*b* and 38*c* for receiving the handle 30. These apertures 38*a*, 38*b* and 38*c* are dimensioned to be aligned with the apertures 26*a*, 26*b* and 26*c* in the outside door panel 16 when the mounting bracket 28 is fixedly installed on the door 14 so that the portions of the handle 30 pass through the apertures 26*a*, 26*b* and 26*c* in the outside door panel 16 and the apertures 38*a*, 38*b* and 38*c* of the mounting bracket 28.

The mounting portion 32 includes a variety of conventional features, such as a lock/latch section 42 and an arcuate section 44. The lock/latch section 42 includes a key operated lock 45 (shown in FIGS. 2, 3, 6 and 7) that is installed in the aperture 38*c* and extends into the aperture 26*c* in the outside door panel 16. The key operated lock 45 is connected via a linkage L to a conventional latching/locking mechanism 46, as shown in FIG. 4.

The lock/latch section 42 includes a shaft 47 and a spring S disposed about a portion of the shaft 47. The shaft 47 is formed with a radially extending pawl 47*a* and a radially extending lever arm 47*b*. The spring S is positioned to bias the pawl 47*a* into movement in a predetermined direction. The pawl 47*a* is dimensioned to engage a portion of the handle 30 such that the biasing of the spring S urges the handle 30 into the latching position as depicted in FIG. 2. This arrangement is described in greater detail below along with a description of features of the handle 30. The lever arm 47*b* is dimensioned to connect to a cable C that extends between the lock/latch section 42 and the latching/locking mechanism 46.

Figure 3:
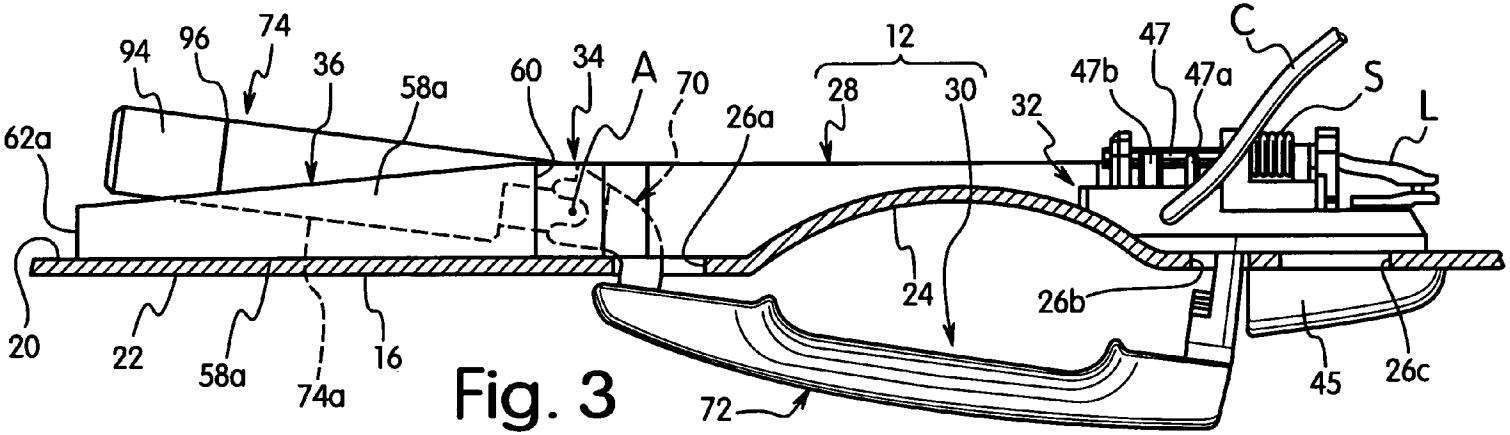
FIG. 3 is a horizontal cross-sectional view, similar to FIG. 2, of a portion of the door showing the door handle assembly in a latch release position in accordance with the present invention.
Figure 4:
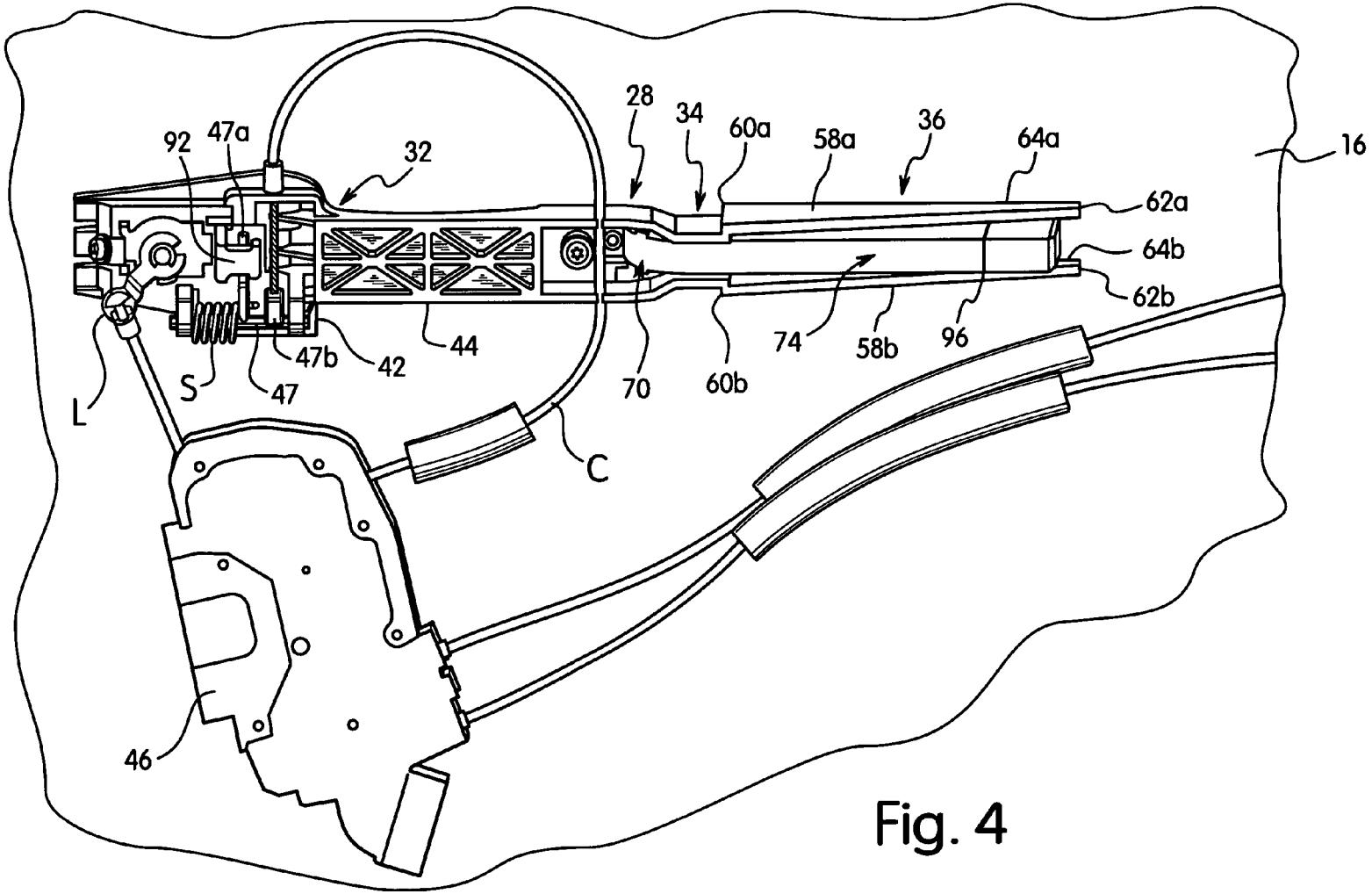
FIG. 4 is an inside perspective view of an interior portion of the door depicted in FIG. 1, showing the door handle assembly and a latching mechanism in accordance with the present invention.

The latching/locking mechanism 46 facilitates opening and closing of the door 14 in a conventional manner in response to movement of the handle 30 from a latching position depicted in FIG. 2 to a latch release position depicted in FIG. 3. The latching/locking mechanism 46 includes a locking mechanism that locks and unlocks the latching/locking mechanism 46 in response to conventional use of the key operated lock 45 in the lock/latch section 42.

As shown in FIG. 2, the arcuate section 44 of the mounting bracket 28 is configured to contact and conform to the shape of the handle recess 24 of the outside door panel 16.

Figure 10:
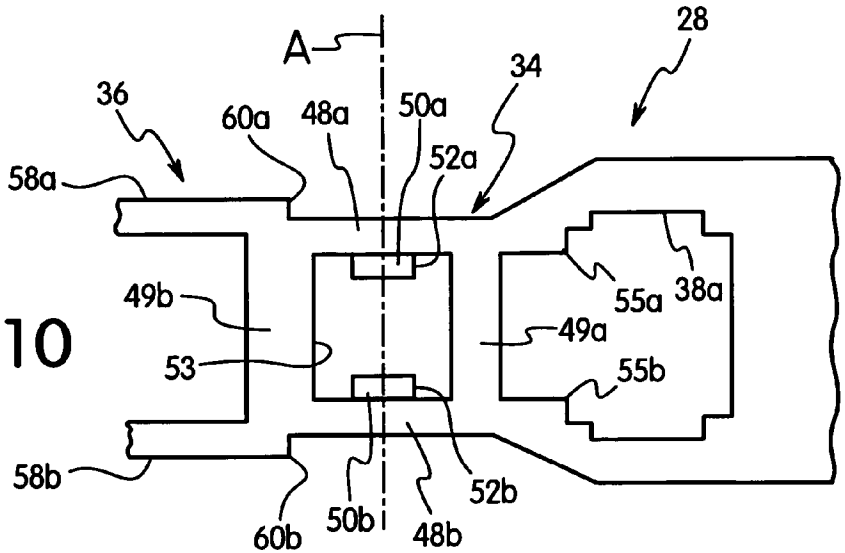
FIG. 10 is an enlarged partial inside elevational view of the mounting bracket of the door handle assembly showing details of a pivot portion of the mounting bracket in accordance with the present invention.
Figure 14:
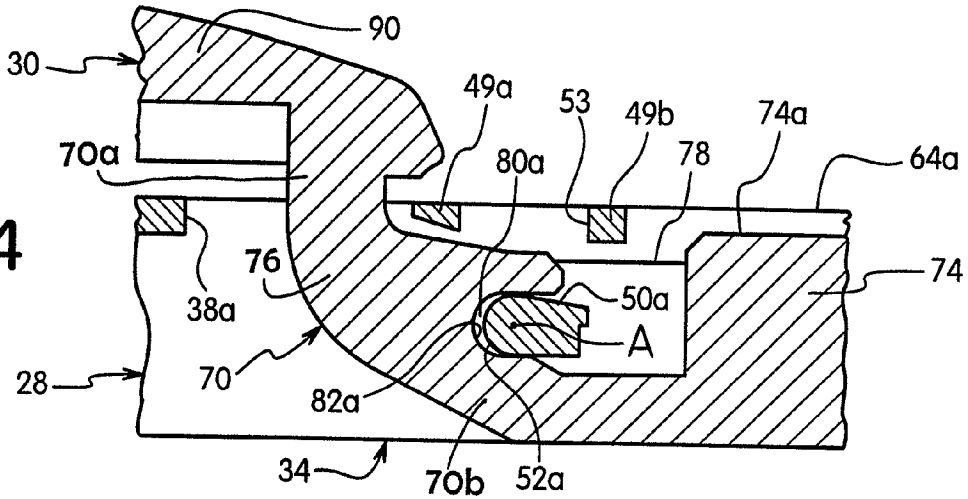
FIG. 14 is a partial cross-sectional view of a first side of the door handle assembly taken along the line 14-14 in FIG. 7, showing details of a first side of the pivot portion of the mounting bracket and the handle of the door handle assembly in accordance with the present invention.
Figure 15:
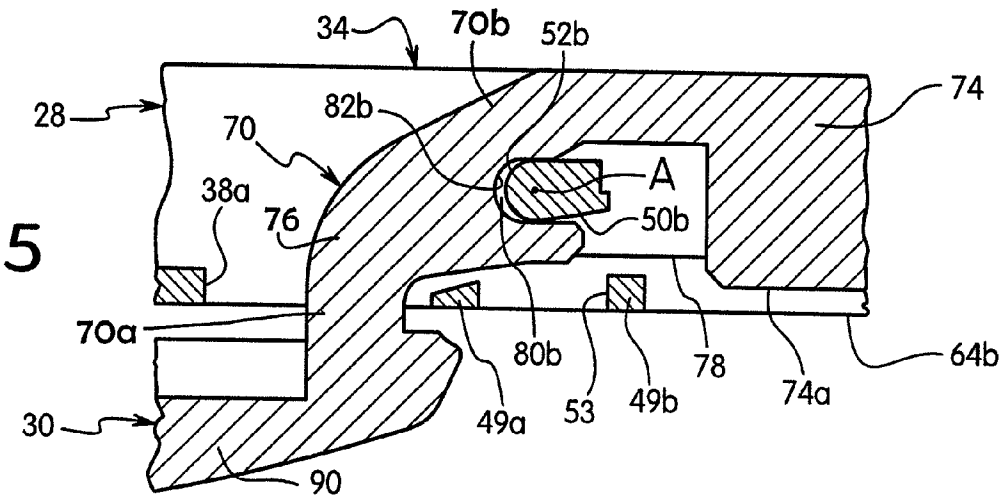
FIG. 15 is a partial cross-sectional view of a second side of the door handle assembly taken along the line 15-15 in FIG. 7, showing details of a second side of the pivot portion of the mounting bracket and the handle of the door handle assembly in accordance with the present invention.

As shown in FIGS. 8, 9 and 10, the support portion 34 includes a pair of parallel walls 48*a* and 48*b* and a pair of connecting ribs 49*a* and 49*b*. Each of the walls 48*a* and 48*b* has an inner surface, respectively, with the walls 48*a* having a protrusion 50*a* and the walls 48*b* having a protrusion 50*b*. The protrusions 50*a* and 50*b* are generally symmetrical and extend toward one another. The protrusions 50*a* and 50*b* are formed with respective curved surfaces 52*a* and 52*b* that extend in a direction generally perpendicular to the inner surfaces of the walls 48*a* and 48*b*. As seen in FIG. 10, the protrusions 50*a* and 50*b* are visible through an opening 53 that is defined by the walls 48*a* and 48*b* and the connecting ribs 49*a* and 49*b*. A center of curvature of the curved surfaces 52*a* and 52*b* approximately defines a pivot axis A, as indicated in FIGS. 14 and 15.

The aperture 38*a* is formed between the support portion 34 and the mounting portion 32. The handle 30 is installed into the mounting bracket 28 such that a portion of the handle 30 extends though the aperture 38*a* and the aperture 26*a* in the door panel 16, in a manner described in greater detail below. Once installed in the mounting bracket 28, the handle 30 pivots about the pivot axis A from the latching position and the latch release position. More specifically, portions of the handle 30 contact and pivot on the curved surfaces 52*a* and 52*b*, as described in greater detail below. The aperture 38*a* further includes a pair of protrusions 55*a* and 55*b* configured and arranged to assist in limiting movement of the handle 30.

Figure 6:
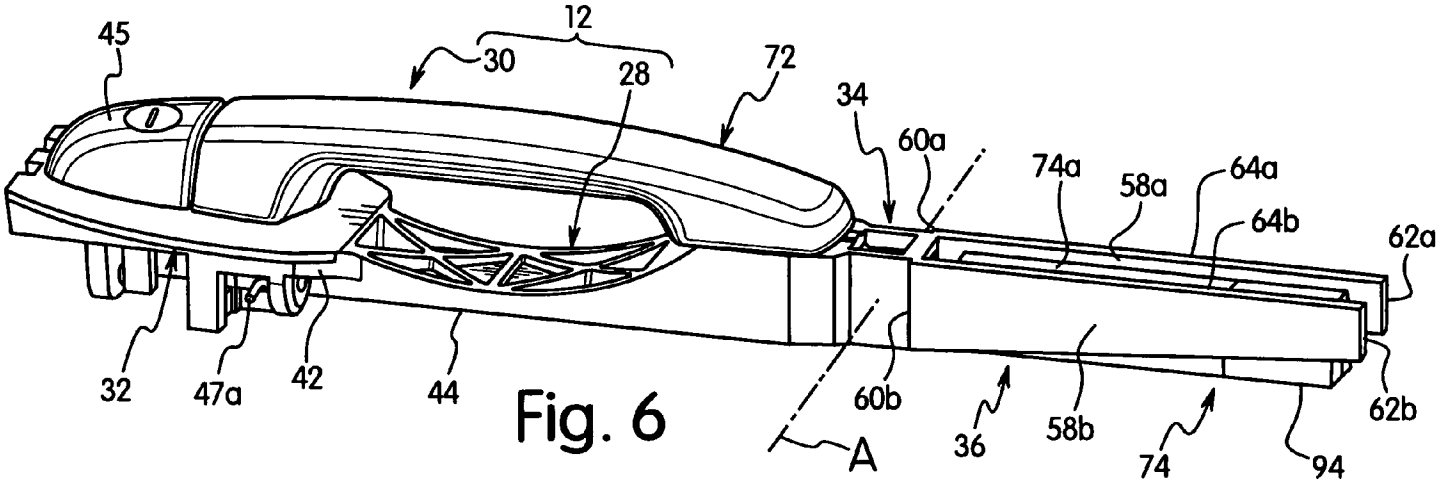
FIG. 6 is another perspective view of the door handle assembly showing the mounting bracket and the handle in accordance with the present invention.

As also shown in FIGS. 6 and 8, the extension portion 36 is an extension of the bracket (a bracket extension) that is formed with a pair of projections 58*a* and 58*b*. Each of the projections 58*a* and 58*b* has a generally flat elongated shape. As clearly shown in FIGS. 8 and 9, the extension portion 36 is configured and arranged to project perpendicularly relative to the pivot axis A. The projections 58*a* and 58*b* are generally parallel to one another and each includes a tapered contour extending generally horizontally toward their distal ends. More specifically, the projection 58*a* has a fixed end 60*a* and a distal end 62*a*, while the projection 58*b* has a fixed end 60*b* and a distal end 62*a*. The fixed ends 60*a* and 60*b* of the projections 58*a* and 58*b* are integrally joined with the support portion 34, such that the projections 58*a* and 58*b* cantilevered therefrom. The fixed ends 60*a* and 60*b* are wider than the distal ends 62*a* and 62*b* with the tapered width reducing in size from the fixed ends 60*a* and 60*b* toward the distal ends 62*a* and 62*b*. The projection 58*a* also includes an outwardly facing edge 64*a* that contacts the inner surface 20 of the outside door panel 16 of the door 14, while the projection 58*b* also include an outwardly facing edge 64*b* that contacts the inner surface 20 of the outside door panel 16 of the door 14. As shown in FIGS. 9 and 10, the projections 58*a* and 58*b* are slightly offset from the walls 48*a* and 48*b*. The offset orientation of the projections 58*a* and 58*b* provides a small amount of space between the projections 58*a* and 58*b* and the handle 30. However, in an alternate embodiment, the projections 58*a* and 58*b* can be arranged to extend from the walls 48*a* and 48*b* with no offset. Distances and tolerances between the projections 58*a* and 58*b* and the handle 30 are purely an engineering consideration dependent upon final use and application of the vehicle door handle assembly 12.

The handle 30 is now described in greater detail with specific reference to FIGS. 11-15. The handle 30 is coupled to the mounting bracket 28 to pivot about the pivot axis A between the latching position (FIG. 2) and the latch release position (FIG. 3). The handle 30 is an elongated member that basically includes a pivot portion 70, a grip portion 72, and a counterbalancing portion 74. The grip portion 72, the pivot portion 70 and at least part of the counterbalancing portion 74 are formed as a one-piece, unitary member.

Figure 11:
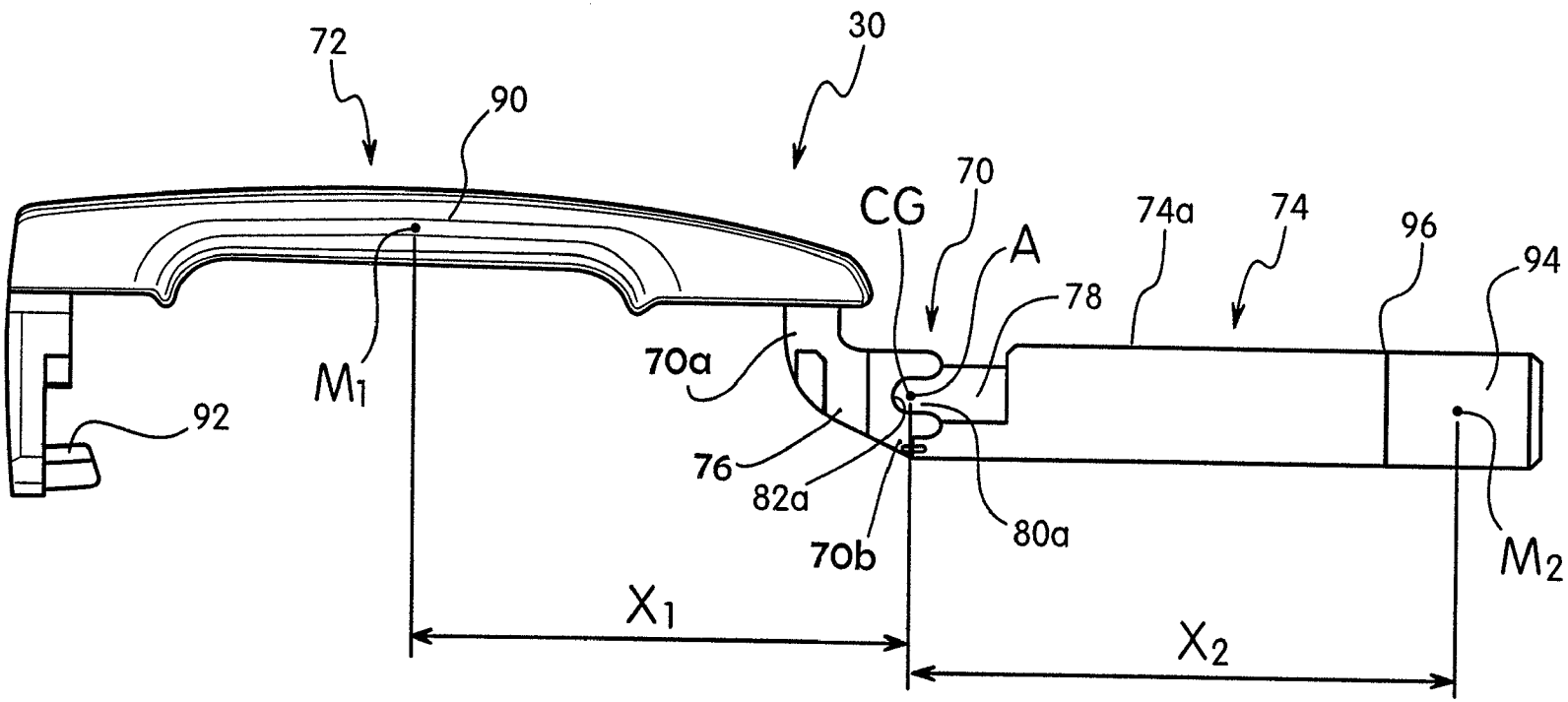
FIG. 11 is a top plan view of the handle of the door handle assembly shown removed from the mounting bracket.
Figure 12:
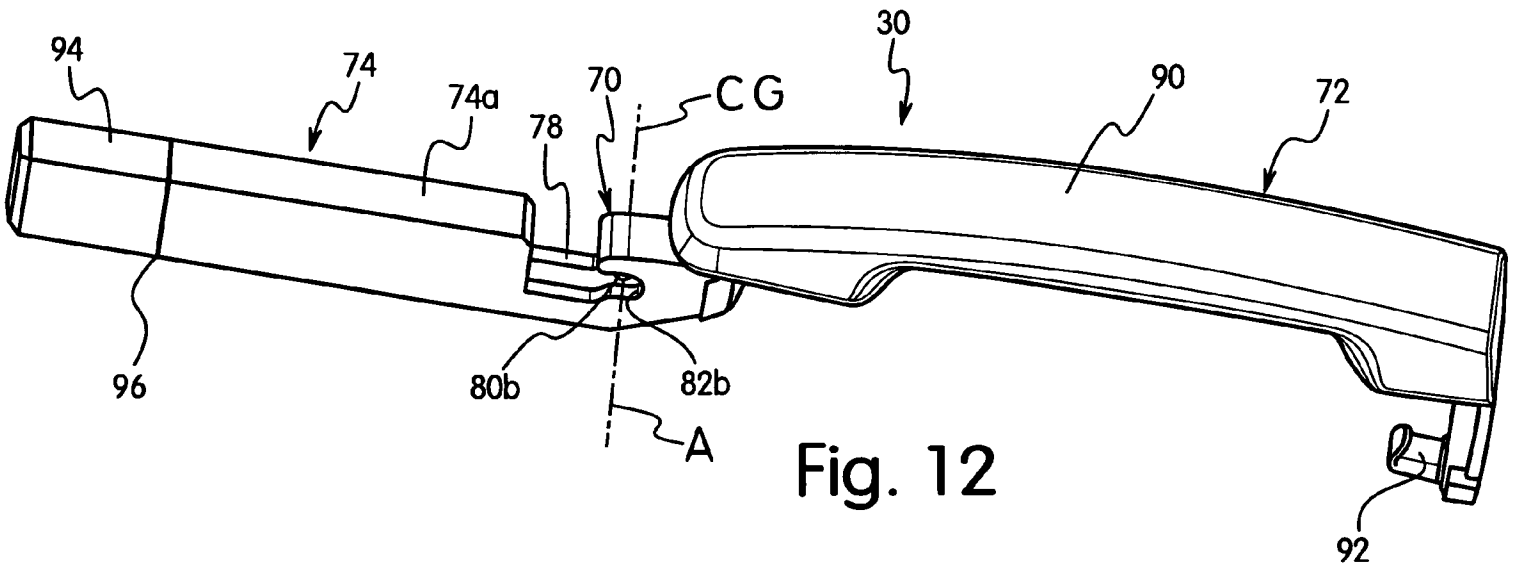
FIG. 12 is a top perspective view of the handle of the door handle assembly shown removed from the mounting bracket.
Figure 13:
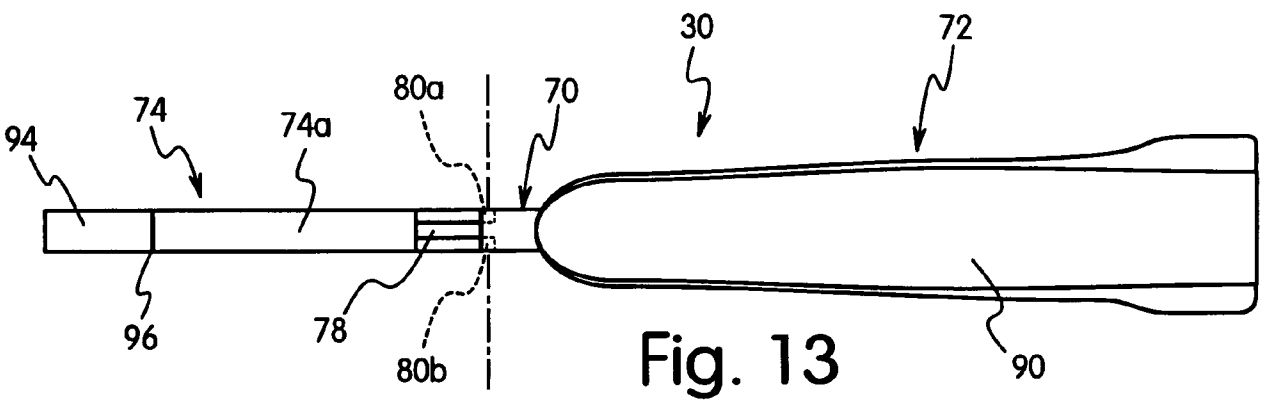
FIG. 13 is an outside elevational view of the handle of the door handle assembly in accordance with the present invention.

As shown in FIGS. 11-13, the grip portion 72 and the counterbalancing portion 74 extend in generally opposite directions relative to the pivot portion 70 and the pivot axis A. The pivot portion 70 is located in a generally central area of the handle 30 between the grip portion 72 and the counterbalancing portion 74. The pivot portion 70 has a first end 70*a* and a second end 70*b* and has an overall arcuate shape that defines an offset section 76. The grip portion 72 extends from the first end 70*a* and the counterbalancing portion 74 extends from the second end 70*b*. The pivot axis A extends through the second end 70*b* of the pivot portion 70 adjacent to the counterbalancing portion 74. The offset section 76 is configured and arranged to extend through the aperture 38*a* in the mounting bracket 28 (and the aperture 26*a* in the outside door panel 16) into the support portion 34 of the mounting bracket 28. The offset section 76 provides an angular offset between the grip portion 72 and the counterbalancing portion 74 such that they extend in opposite directions that are generally parallel to one another. More specifically, between the first end 70*a* and the second end 70*b*, the shape of the offset section 76 defines an approximately 90 degree arcuate curve, as shown in FIG. 11. Furthermore, the offset arrangement of the offset section 76 allows for the majority of the grip portion 72 to extend in an area outside the door 14, adjacent to the handle recess 24, as shown in FIGS. 2 and 3. However, the counterbalancing portion 74 is completely disposed within the door 14 between the outside and inside door panels 16 and 18 as is also shown in FIGS. 2 and 3.

The second end 70*b* of the pivot portion 70 includes an area of reduced thickness that defines a thin wall 78 and a pair of symmetrical recesses 80*a*(FIG. 11) and 80*b*(FIG. 12) that are formed on opposing sides of the thin wall 78. A portion of surfaces of the thin wall 78 define a bottom of the recesses 80*a* and 80*b*. The recesses 80*a* and 80*b* are further defined by a pair of arcuate surfaces 82*a* and 82*b*, respectively, as best shown in FIGS. 14 and 15. The arcs of the arcuate surfaces 82*a* and 82*b* have center points that coincide with the pivot axis A when the handle 30 is installed in the mounting bracket 28. The thin wall 78 extends from the second end 70*b* of the pivot portion 70 relative to the pivot axis A and away from the offset section 76. Hence, the grip portion 72 extends from the first end 70*a* of the pivot portion 70 and the offset section 76 and the counterbalancing portion 74 extends from the second end 70*b* of the pivot portion 70 and the offset section 76.

Figure 5:
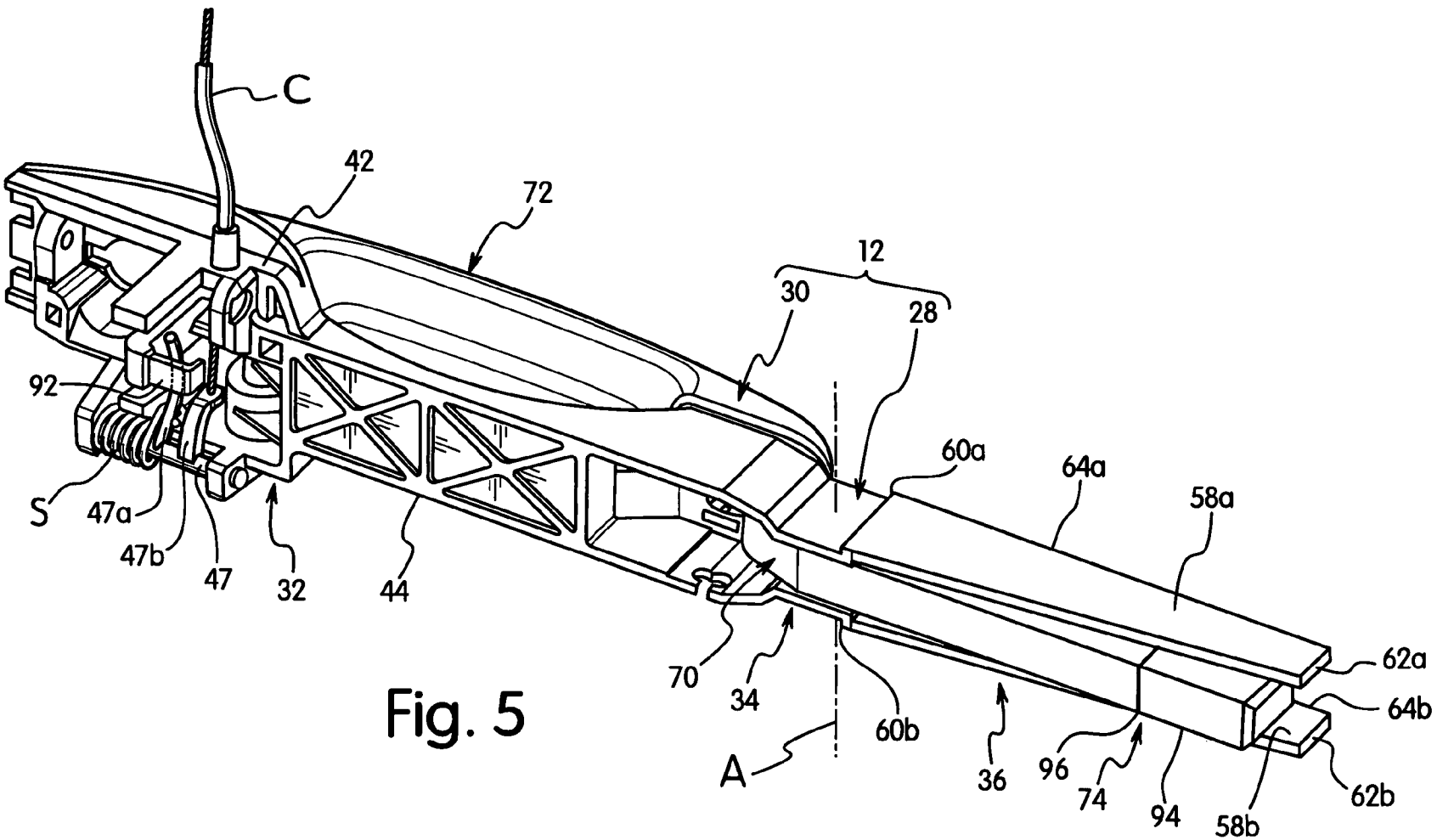
FIG. 5 is an inside perspective view of the door handle assembly removed from the vehicle to show the mounting bracket and the handle in accordance with the present invention.

The grip portion 72 includes a contoured section 90 and a latch projection 92. The contoured section 90 has a curved shape that provides a comfortable surface for a passenger's hand to grip when opening the door 14. The latch projection 92 is shaped to engage the pawl 47, as indicated in FIG. 2, 4 and 5. The grip portion 72 has a first mass $M_1$ with a corresponding center of gravity located at a distance $X_1$ from the pivot axis A. The grip portion 72 extends generally perpendicularly relative to a plane passing through the pivot axis A of the pivot portion 70. The grip portion 72 is configured and arranged relative to the mounting bracket 28 to be operated from the exterior of the door 14.

The counterbalancing portion 74 extends generally perpendicularly relative to a plane passing through the pivot axis A of the pivot portion 70. The counterbalancing portion 74 has an outwardly facing surface 74*a*. The counterbalancing portion 74 extends from the second side of the pivot portion 70. As shown in FIG. 6, the counterbalancing portion 74 is recessed or spaced apart from the outwardly facing edges 64*a* and 64*b* of the projections 58*a* and 58*b*. Specifically, the surface 74*a* of the counterbalancing portion 74 is recessed or spaced apart from outwardly facing edges 64*a* and 64*b* of the projections 58*a* and 58*b* by a prescribed distance to prevent the outside door panel 16 from being deformed to contact the surface 74*a* of the counterbalancing portion 74 during a collision. As indicated in FIGS. 2 and 3, the counterbalancing portion 74 moves away from the outwardly facing edges 64*a* and 64*b* of the projections 58*a* and 58*b* when moving from the latching position (FIG. 2) to the latching release position (FIG. 3). Therefore, the surface 74*a* of the counterbalancing portion 74 is always offset from the outwardly facing edges 64*a* and 64*b* of the projections 58*a* and 58*b*.

The counterbalancing portion 74 includes a counterweight 94 fixedly coupled at a distal end 96 of the counterbalancing portion 74. The counterweight 94 of the counterbalancing portion 74 is preferably constructed of a metallic material, while the remainder of the counterbalancing portion 74 is primarily formed from a non-metallic material, such as a plastic or polymer composition. As shown in the drawings, the counterweight 94 is a separate weight that is attached to the counterbalancing portion 74 by adhesives, mechanical fasteners or molded therewith. It should be understood from the drawings and the description herein that the handle 30 alternatively can be formed as a one piece unitary member, with the counterweight 94, the grip portion 72, the pivot portion 70 and the counterbalancing portion 74 all formed of the same material. In still another alternative configuration, the counterweight 94 can be a metallic or other dense material embedded into the counterbalancing portion 74, thereby surrounded by a polymer or plastic material used to form the grip portion 72, the pivot portion 70 and the counterbalancing portion 74.

Figure 7:
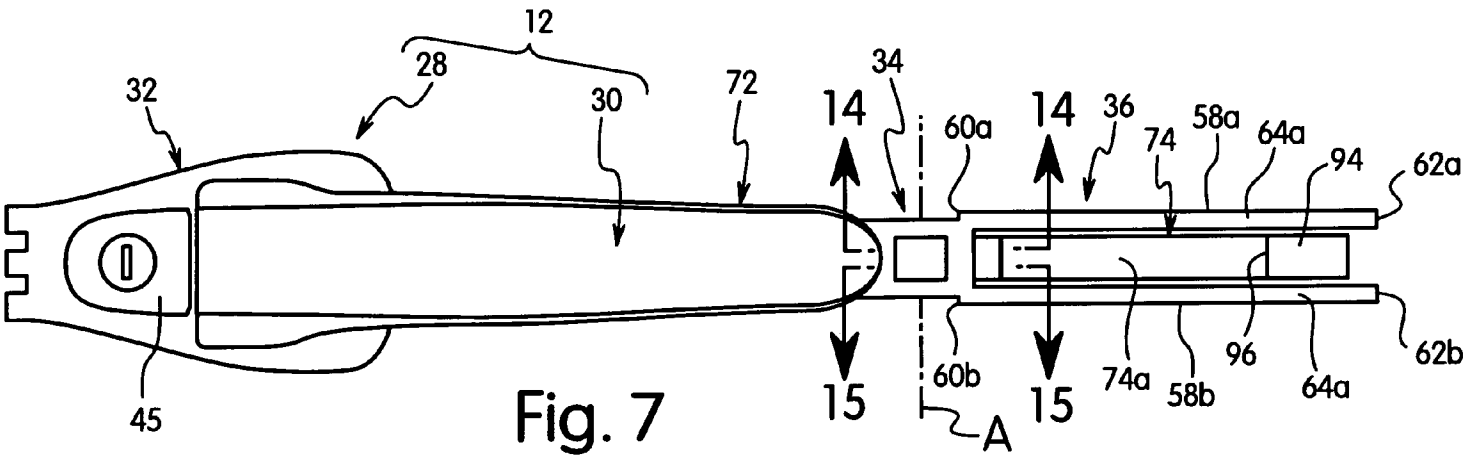
FIG. 7 is an outside elevational view of the door handle assembly showing various aspects of the mounting bracket and the handle in accordance with the present invention.

In the depicted embodiment, the counterbalancing portion 74 (and the counterweight 94) at least partially extends between the projections 58*a* and 58*b* of the extension portion 36 of the mounting bracket 28 when the handle 30 in the latching position, as shown in FIGS. 6 and 7. The counterbalancing portion 74 and the projections 58*a* and 58*b* of the mounting bracket 28 are arranged and configured to extend within the interior portion of the door 14 between the outside door panel 16 and the inside door panel 18. The counterbalancing portion 74 has a second mass $M_2$ with a corresponding counterbalancing center of gravity on the second side of the pivot axis A that is a distance $X_2$ away from the pivot axis A. The first mass $M_1$ and the second mass $M_2$ are designed and balanced such that a center of gravity CG of the handle 30 is located proximate the pivot axis A. Specifically, with reference to FIG. 11, one of the following relationship is preferred:

$$M_1 \times X_1 \approx M_2 \times X_2$$

or $$M_1 \times X_1 = M_2 \times X_2$$

In other words, the handle 30 is balanced so that its overall center of gravity CG is located close to or coincides with the pivot axis A. By balancing of the handle 30, the spring S can be designed with a smaller biasing force such that the force required to pull the grip portion 72 of the handle 30 to open the door 14 is reduced. Therefore, the handle 30 operates with greater ease. Also, the extension portion 36 is a bracket extension that is configured and arranged to protect the counterbalancing portion 74 from being moved during a side impact. In other words, in response to a side impact against the door 14, the extension portion 36 limits deformation of the outside door panel 16 to prevent movement of the counterbalancing portion 74 by this deformation of the outside door panel 16. Specifically, the extension portion 36 is configured and arranged to project perpendicularly relative to the pivot axis A such that the counterbalancing portion 74 is recessed between the projections 58*a* and 58*b* from the outwardly facing edge 58*a* of the bracket extension 36 in a direction of pivotal movement of the handle 30 from the latching position to the latching release position. In other words, the counterbalancing portion 74 is spaced apart from the outwardly facing edges 64*a* and 64*b* and spaced apart from the outside door panel 16 with the handle 30 in the latched position (FIG. 2). Therefore, as the handle 30 moves to the unlatching position (FIG. 3), the counterbalancing portion 74 moves away from the outside door panel 16. Consequently, the outwardly facing edges 64*a* and 64*b* of the projections 58*a* and 58*b* protect the counterbalancing portion 74 against movement in the event of a side vehicular impact. More specifically, during side vehicular impact, the outer door panel 16 could be impacted and deformed. Some of the impact force imparted to the outer door panel 16 can be transmitted to the projections 58*a* and 58*b*. However, the counterbalancing portion 74 is recessed (spaced apart) from the outwardly facing edges 64*a* and 64*b* of the projections 58*a* and 58*b* as shown in FIG. 6. If the outside door panel 16 is deformed by the impact, the impact force transmitted to the outwardly facing edges 64*a* and 64*b* of the projections 58*a* and 58*b* will not likely affect the counterbalancing portion 74 because the counterbalancing portion 74 is spaced apart from the outside door panel 16. Further, the entire vehicle door handle assembly 12 will move with deformation of the outside door panel 16. The counterbalancing portion 74 is not moved relative to the mounting bracket 28, and therefore, the vehicle door handle assembly 12 is prevented from operating the locking mechanism 46 and opening the door 14.

During installation, the mounting bracket 28 is installed on the inner surface 20 of the outside door panel 16 of the door 14 by fasteners, or other conventional mechanical connections. After the mounting bracket 28 is installed, the handle 30 is mounted to the mounting bracket 28 as follows. First, the counterbalancing portion 74 is inserted into the aperture 26*a* in the outside door panel 16 and through the aperture 38*a* in the mounting bracket 28. Next, the handle 30 is rotated so that the pivot portion 70 becomes engaged in the support portion 34 of the mounting bracket 28. Simultaneously, the latch projection 92 is inserted into the aperture 26*b* in the outside door panel and the aperture 38*b* of the mounting bracket 28 for engagement with the pawl 47*a*. Consequently, the grip portion 72 remains outside the door 14, while the pivot portion 70, the counterbalancing portion 74 and a portion of the latch projection 92 remain within the interior of the door 14.

In operation, the handle 30 is pulled from the latched position (FIG. 2) to the unlatching position (FIG. 3) causing the latch projection 92 to move the pawl 47*a* due to the biasing force of the spring S. Movement of the pawl 47*a* causes rotation of the shaft 47, which in turn causes movement of the cable C to open the door 14.

As used herein to describe the above embodiment, the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention. The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A vehicle door handle assembly installed to an outside door panel having a first side having an outer surface and a second side having an inner surface, with a first handle receiving aperture extending between the inner and outer surfaces at a first location and a second handle receiving aperture extending between the inner and outer surfaces at a second location that is longitudinally spaced from the first handle receiving aperture, the vehicle door handle assembly comprising:

a mounting bracket mounted to the outside door panel; and a handle pivotally coupled to the mounting bracket to pivot about a pivot axis between a latching position and a latch release position, the handle being an elongated member with a grip portion disposed on the first side of the panel, a counterbalancing portion disposed on the second side of the panel, and a pivot portion connecting the grip portion and the counterbalancing portion together, the grip portion including a first end with a latch projection extending through the first handle receiving aperture and a second end connected to the pivot portion, which extends through the second handle receiving aperture, the pivot axis being located at a first lateral side of the second handle receiving aperture and the first handle receiving aperture being located at a second lateral side of the second handle receiving aperture opposite the first lateral side when viewed perpendicularly to the outer surface of the outside door panel, the grip portion and the counterbalancing portion being configured and dimensioned such that a center of gravity of the handle is located proximate the pivot axis.

2. The vehicle door handle assembly as set forth in claim 1, wherein the grip portion, the pivot portion and at least part of the counterbalancing portion are formed as a one-piece, unitary member.

3. The vehicle door handle assembly as set forth in claim 2, wherein the counterbalancing portion has a distal end that includes a counterweight fixedly coupled thereto.

4. The vehicle door handle assembly according to claim 3, wherein the counterweight is constructed of a metallic material and the handle is constructed of a non-metallic material.

5. The vehicle door handle assembly as set forth in claim 1, wherein the mounting bracket includes a bracket extension that is configured and arranged to project perpendicularly relative to the pivot axis such that the counterbalancing portion is recessed from an outwardly facing edge of the bracket extension in a direction of pivotal movement of the handle from the latching position to the latching release position.

6. The vehicle door handle assembly as set forth in claim 5, wherein the bracket extension includes two generally parallel projections and the counterbalancing portion of the handle at least partially extends between the parallel projections with the handle in the latching position.

7. The vehicle door handle assembly as set forth in claim 6, wherein the two generally parallel projections of the bracket extension of the handle bracket include a tapered contour extending generally horizontally toward their distal ends.

8. The vehicle door assembly as set forth in claim 5, wherein the bracket extension is arranged and configured such that in response to a side impact against the outside door panel the bracket extension limits movement of the counterbalancing portion.

9. The vehicle door assembly as set forth in claim 1, wherein the pivot portion has an arcuate shape extending from the first end to the second end providing an offset between the grip portion and the counterbalancing portion.

10. A vehicle door handle assembly configured for installation to a vehicle door, the vehicle door handle assembly comprising:

a mounting bracket configured and dimensioned to be mounted within a vehicle door, the mounting bracket having a support portion and a bracket extension, the support portion of the mounting bracket including a first end with a latching mechanism and a second end with the bracket extension extending therefrom, the support portion further including a vehicle exterior facing side and a vehicle interior facing side that extend between the first and second ends of the support portion; and a handle pivotally coupled to the second end of the support portion of the mounting bracket to pivot about a pivot axis between a latching position and a latch release position, the handle being an elongated member having a grip portion, a pivot portion and a counterbalancing portion located at the bracket extension of the mounting bracket, with the pivot portion extending between the grip portion and the counterbalancing portion, the pivot axis extending through the pivot portion adjacent to the counterbalancing portion, with the counterbalancing portion extending from the pivot axis in a direction opposite from the grip portion, the pivot portion being disposed entirely between the pivot axis and the first end of the support portion of the mounting bracket and spaced apart from the bracket extension of the mounting bracket as viewed perpendicular to the exterior facing side of the support portion, the bracket extension being configured and arranged to project perpendicularly relative to the pivot axis such that the counterbalancing portion is recessed from an outwardly facing edge of the bracket extension in a direction of pivotal movement of the handle from the latching position to the latching release position, the grip portion and the counterbalancing portion being configured and dimensioned such that a center of gravity of the handle is located proximate the pivot axis.

11. The vehicle door handle assembly as set forth in claim 10, wherein the bracket extension includes two generally parallel projections and the counterbalancing portion of the handle at least partially extends between the parallel projections with the handle in the latching position.

12. The vehicle door handle assembly as set forth in claim 10, wherein the grip portion and at least part of the counterbalancing portion are formed as a one-piece, unitary member.

13. The vehicle door assembly as set forth in claim 10, wherein the pivot portion has an arcuate shape extending from the first end to the second end providing an offset between the grip portion and the counterbalancing portion.

14. The vehicle door assembly as set forth in claim 13, wherein the grip portion, the pivot portion and at least part of the counterbalancing portion are formed as a one-piece, unitary member.

* * * * *